US007684738B2

(12) United States Patent
Izawa et al.

(10) Patent No.: US 7,684,738 B2
(45) Date of Patent: Mar. 23, 2010

(54) DEVELOPER FEEDER FOR WET DEVELOPING APPARATUS

(75) Inventors: Hideo Izawa, Narashino (JP); Takao Namiki, Narashino (JP); Junichi Setoyama, Narashino (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 226 days.

(21) Appl. No.: 11/643,140

(22) Filed: Dec. 21, 2006

(65) Prior Publication Data

US 2007/0147897 A1 Jun. 28, 2007

(30) Foreign Application Priority Data

Dec. 22, 2005 (JP) ..... 2005-369899

(51) Int. Cl.
*G03G 15/10* (2006.01)

(52) U.S. Cl. ..... 399/237

(58) Field of Classification Search ..... 399/237, 399/239, 57, 249

See application file for complete search history.

(56) References Cited

U.S. PATENT DOCUMENTS 6,735,408 B2 * 5/2004 Yoshino et al. ..... 399/237
2003/0133725 A1 7/2003 Park et al.

FOREIGN PATENT DOCUMENTS

| | | |
|---|---|---|
| JP | 11-202631 | 7/1999 |
| JP | 2002-202662 | 7/2002 |
| JP | 2002 278305 | 9/2002 |
| JP | 2003 098835 | 4/2003 |

OTHER PUBLICATIONS

Computer Translation of JP2002-278305A.*
Search Report dated Oct. 14, 2007 for the European Application No. 06 12 6256.

* cited by examiner

*Primary Examiner*—Quana M Grainger
(74) *Attorney, Agent, or Firm*—Cohen Pontani Lieberman & Pavane LLP

(57) ABSTRACT

A developer feeder for wet developing apparatus having a developing roller rotationally engaged with a photoconductor drum and a feed roll in part immersed in a liquid developer and rotationally engaged with the developing roller for supplying the liquid developer onto the developing roller can be made to furnish the peripheral surface of the developing roller with the liquid developer even in thickness by using a plurality of feed rollers which are not mesh rollers but whose peripheral surfaces are smooth and which are arranged circumferentially of the rotational developing roller.

7 Claims, 4 Drawing Sheets

DEVELOPER FEEDER FOR WET DEVELOPING APPARATUS

TECHNICAL FIELD

The present invention relates to a developer feeder for wet developing apparatus for forming a toner image on a photoconductor drum (latent image retainer) with a liquid developer.

BACKGROUND ART

FIG. 1 shows an example of the conventional developer feeder for wet developing apparatus. A photoconductor drum a as a latent image retainer has one developing roller b engaged therewith rotatably at a peripheral speed identical to that at which the drum is rotated, and the developing roller b is supplied with a liquid developer from a feed roller c (see, for example, JP H11-202631 A).

While the feed roller c in this conventional developer feeder has its peripheral surface smooth, a developer feeder is also known using as the feed roller an anilox roller which is formed on its peripheral surface with minute projections and recesses and rotated in a direction opposite to that in which the developing roller b is rotated (see, for example, JP 2001-202662 A).

The developing and feed rollers b and c are such that imparting an adequate close distance and/or contact pressure between their surfaces while applying an appropriate voltage difference (e. g., 200 V) between them allows toner particles of the liquid developer to electrophoretically migrate toward and deposit on the lower potential surface to form a thin uniform developer film on the developing roller b.

In the developer feeder of this type, however, an assembling error of the developing and feed rollers and their dimensional errors at the time of manufacture inevitably cause their axes to be skewed and their cross sections to become out of round and to be decentered with the result that the contact pressure and close distance become uneven for roller axial directions or angles of rotation and in turn that the thin developer film layer supplied onto the developing roller becomes out of constant in thickness and in turn that the development density onto the photoconductor drum becomes uneven and hence the images transferred may become poor in density.

While to overcome this inconvenience there is a developer feeder using as a feed roller an anilox roller (mesh roller) having formed on its surface with minute projections and recesses as shown in JP 2002-202662 A, the problem arises there that the minute projections and recesses on the feed roller come to remain transcribed in the thin developer film layer on the developing roller as well as the problem that the feed rate of liquid developer cannot be changed unless the rollers are each changed with another and the problem of premature wear of the developing and feed rollers due to their rotating in opposite circumferential directions.

DISCLOSURE OF THE INVENTION

Made with these inconveniences taken into account, the present invention has for an object to provide a developer feeder for wet developing apparatus which without using a mesh roller is capable of furnishing the peripheral surface of a developing roller with a liquid developer uniform in thickness.

In order to achieve the object mentioned above, there is provided in accordance with the present invention a developer feeder for wet developing apparatus, comprising a developing roller rotationally engaged with a photoconductor drum and a feed roll in part immersed in a liquid developer and rotationally engaged with the developing roller for supplying the liquid developer onto the developing roller, wherein a plurality of such feed rollers whose peripheral surfaces are smooth are arranged circumferentially of the rotational developing roller.

According to the present invention, the use of a plurality of such feed rollers which are not mesh rollers allows reducing the unevenness in thickness of a thin developer film layer that is created by the unevenness in gap between a supply roller and the developing roller, thereby preventing the developing density on the photoconductor drum from becoming poor.

In the developer feeder mentioned above, the feed rollers may be rotated at an identical peripheral speed each other and in an identical circumferential direction to that in which the developing roller is rotated and the peripheral speed may be made variable.

With the developer feeder so constructed as mentioned above, rotating a plurality of feed rollers at an identical peripheral speed each other while making the peripheral speed variable allows controlling the thin developer film layer in thickness formed on the peripheral surface of the developing roller by adjusting the difference in peripheral speed between the feed and developing rollers.

Further in the developer feeder mentioned above, a smoother roller axially movable to reciprocate while rotating at an identical circumferential direction to that in which the developing roller is rotated may be positioned for rotational engagement with the developing roller between a place at which the feed roller downstream rotationally of the developing roller is rotationally engaged therewith and a place at which the developing roller is rotationally engaged with the photoconductor drum.

According the developer feeder so constructed as mentioned above, if a smoother roller axially movable to reciprocate while rotating at an identical circumferential direction to that in which the developing roller is rotated is positioned downstream of one downstream-most of the rollers and upstream of a place at which the developing roller is rotationally engaged with the photoconductor drum, the thin developer film layer furnished onto the developing roller from the supply rollers can be made even in thickness while removing an excess of the liquid developer, thereby permitting the liquid developer which is uniform in thickness and high in density to be furnished onto the photoconductor drum and an image least in density difference and excellent in quality to be obtained.

DESCRIPTION OF A PREFERRED EMBODIMENT

Figure 1:
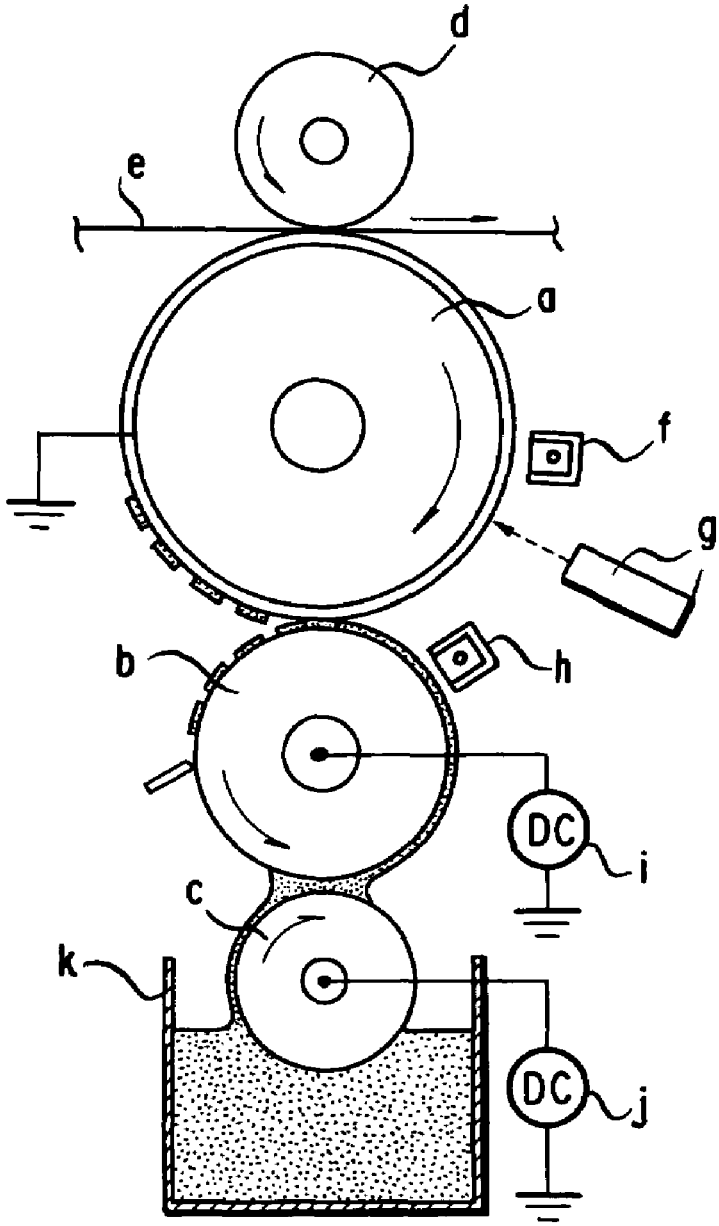
FIG. 1 is an explanatory view illustrating wet developing apparatus with a conventional developer feeder.
Figure 2:
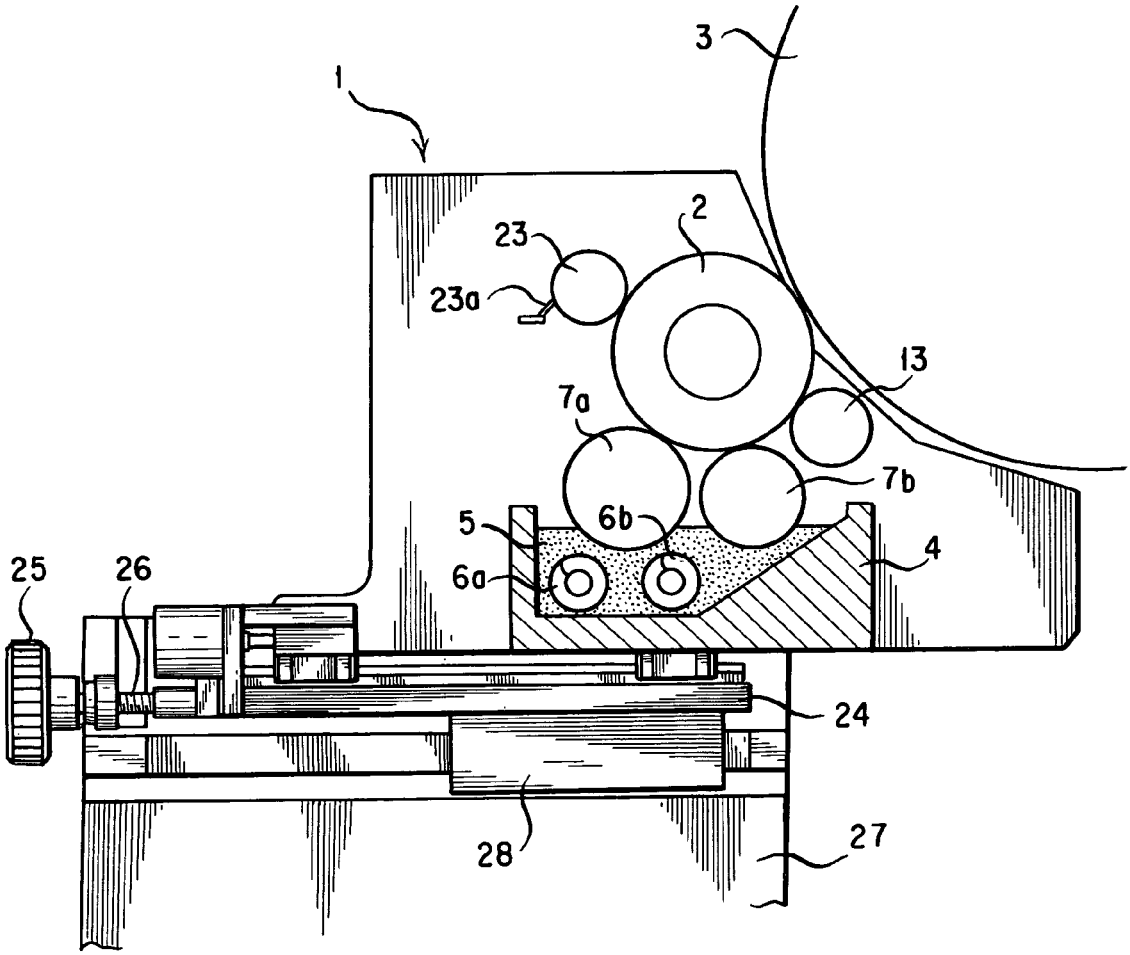
FIG. 2 is an explanatory view illustrating an embodiment of a developer feeder according to the present invention.
Figure 3:
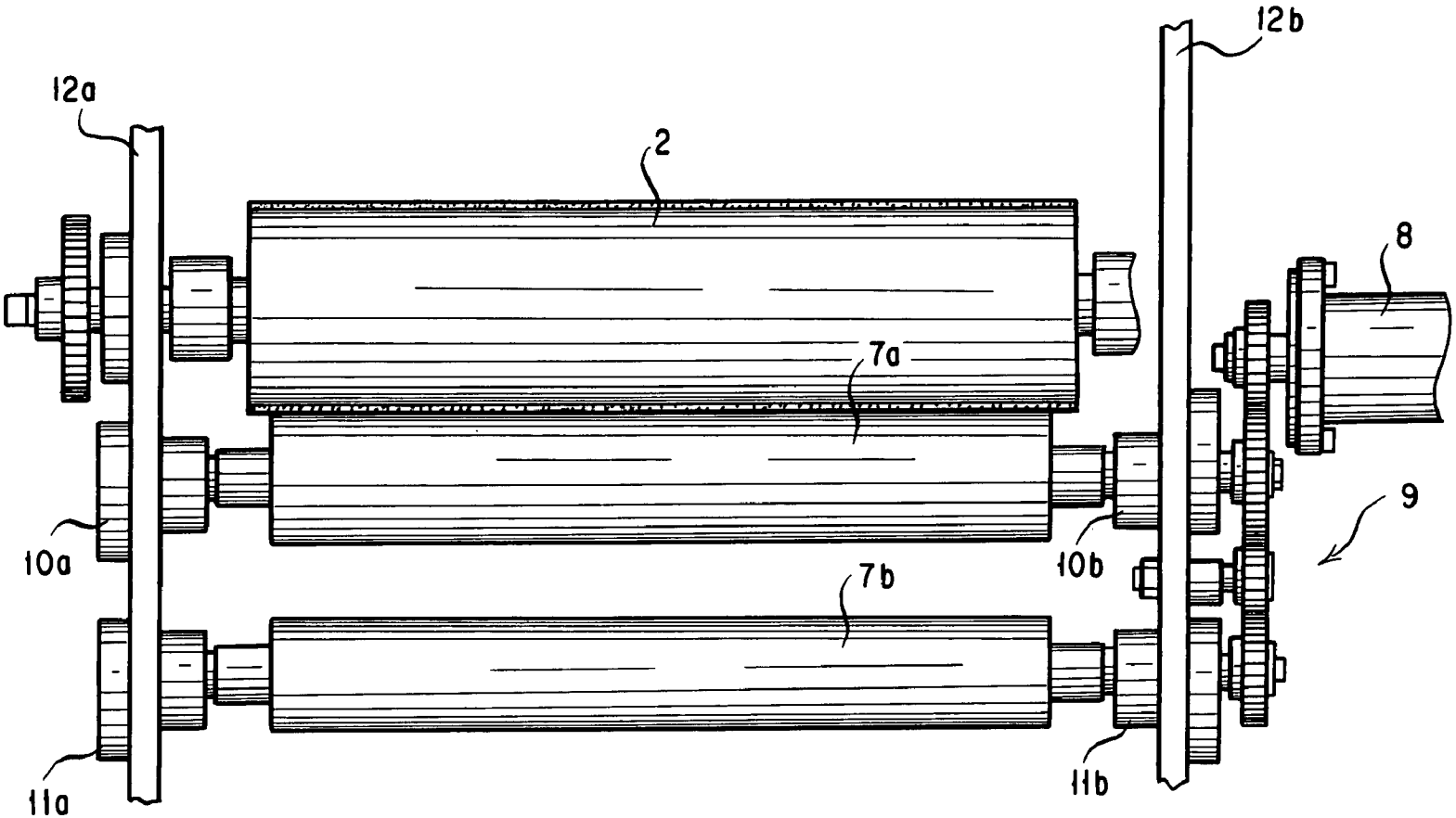
FIG. 3 is an explanatory view illustrating a drive system for a feed roller in the developer feeder shown in FIG. 2.
Figure 4:
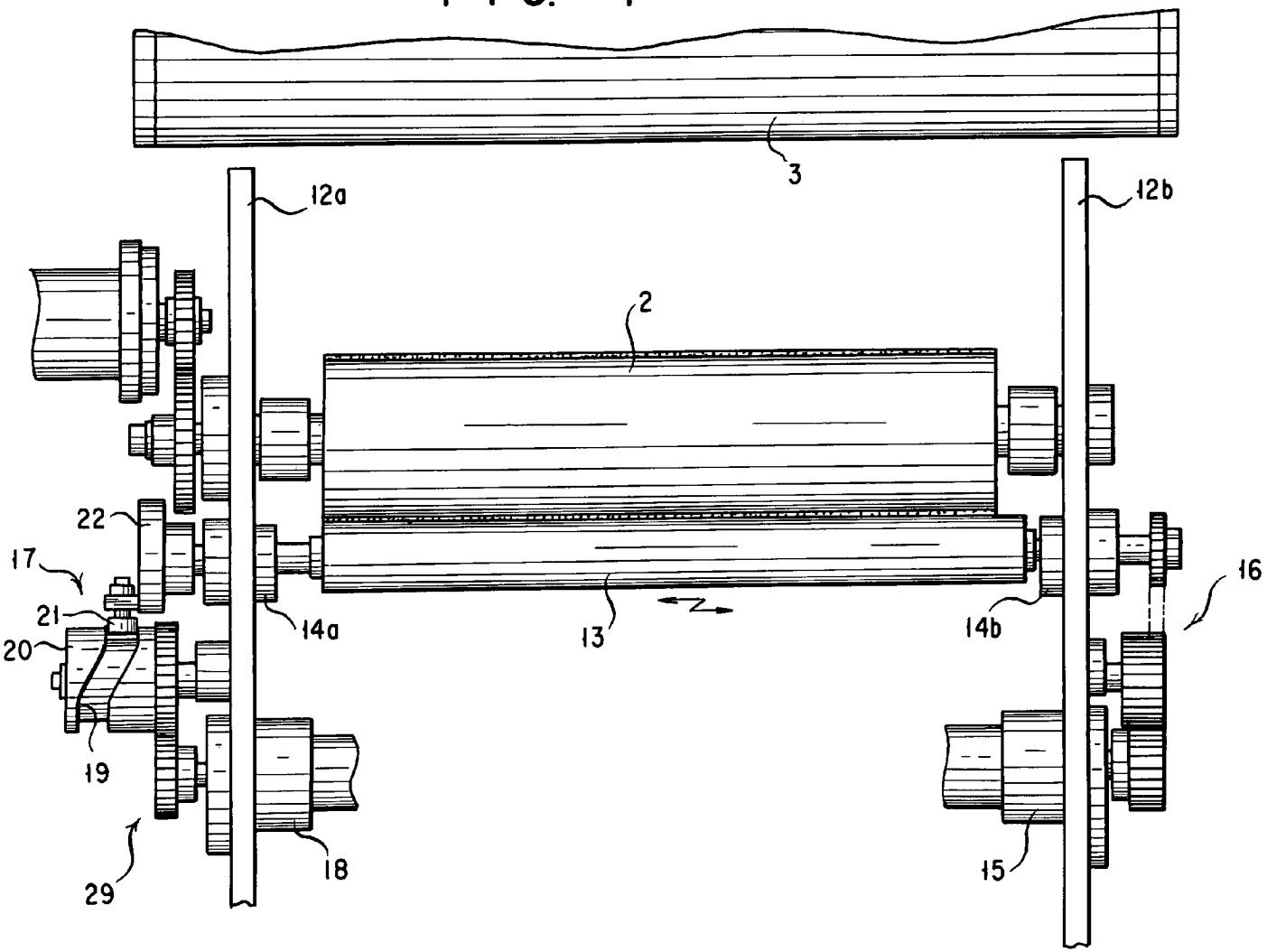
FIG. 4 is an explanatory view illustrating a drive system for a smoother roller in the developer roller shown in FIG. 2.

FIGS. 2 to 4 show essential parts of a developer feeder 1 according to the present invention. In the Figures, a developing roller 2 and a photoconductor drum 3 are rotatably engaged with each other as are conventional. The developing roller 2 is supported by frames 12*a* and 12*b*. The photoconductor drum 3 is formed on its surface in a photosensitizing station (not shown) with a latent image, which is developed by a liquid developer attached to the surface of the developing roller into a toner image, which in turn is transferred onto a recording sheet (not shown) passing between the photoconductor drum 3 and a transfer roller (not shown). In this form of implementation, too, a bias voltage is applied to each of the developing roller 2 and a feed roller section to be described later.

Below the developing roller 2 there is disposed a developer tank 4 opened upward, in which a liquid developer 5 is contained to a given level. Agitators 6*a* and 6*b* are disposed in the developer tank 4 for rotation to stir the developer 5 in the developer tank 4. The agitators 6*a* and 6*b* are each in the form of a screw and coupled to a motor (not shown) so that they can be rotated in opposite directions.

Disposed beneath the developing roller 2 are the a plurality of, say two, feed rollers 7*a* and 7*b*. These feed rollers 7*a* and 7*b* are disposed so that they are rotatably engaged with the developing roller 2 at positions deviated from each other circumferentially of the rotational developing roller 2 with a spacing of 0.2 to 0.3 mm between their peripheral surfaces at each of the positions of rotational engagement.

The feed rollers 7*a* and 7*b* are varied in diameter from each other and coupled to a variable motor 8 via a coupling mechanism 9 as shown in FIG. 3 so that they are rotated at an identical peripheral speed each other and in a direction identical to that in which the developing roller 2 is rotated where they are opposed to the developing roller 2, respectively. And, these feed rollers 7*a* and 7*b* are made such that controlling the variable motor 8 may make their peripheral speed of rotation variable.

The feed rollers 7*a* and 7*b* are supported by frames 12*a* and 12*b* via eccentric bearings 10*a*, 10*b*; 11*a*, 11*b* supporting the opposite ends of the feed rollers, respectively. These eccentric bearings 10*a*, 11*a*; and 10*b*; 11*b* are rotatably mounted to the frames 12*a* and 12*b*, respectively, in the state that the eccentric bearings 10*a*, 10*b*; 11*a*, 11*b* are made eccentric with the axes of the feed rollers 7*a* and 7*b*, respectively, so that rotating the eccentric bearings 10*a*, 10*b*; 11*a*, 11*b* changes their mounting positions to change the distance between the each of the feed rollers 7*a* and 7*b* and the developing roller 2 in rotational engagement.

A smoother roller 13 is mounted in rotational engagement with the peripheral surface of the developing roller 2 downstream of the feed rollers 7*a* and 7*b* under a pressure such that a nip width of 3 to 5 mm results.

The smoother roller 13 is supported by the frames 12*a* and 12*b* via eccentric bearings 14*a* and 14*b* so that the above mentioned nip width can be adjusted. And, the smoother roller 13 is supported by the eccentric bearings 14*a* and 14*b* so as to be movable axially while rotating. The smoother roller 13 has its end coupled to a motor 15 via a coupling mechanism 16 so as to be rotatable at a variable peripheral speed and its other end coupled to a motor 18 via a reciprocating mechanism 17.

The reciprocating mechanism 17 comprises a cam shaft 20 having a cam groove 19 looped around the cam shaft 20 along a distorted lead curve to give a selected lead length, a cam slide 21 engaged with the cam groove 19 and a disk member 22 supporting the cam slide 21 on its one end face and axially engaged with and rotatably coupled to the other end of the smoother roller 13 wherein the cam shaft 20 is coupled to a motor 18 via a coupling mechanism 29. Thus, the smoother roller 13 while being rotated by the motor is axially reciprocated over the selected lead length of the cam groove 19 when motion of the cam shaft 20 to rotate is transmitted to the disk member 22 via the cam groove 19 and the cam slide 21. While its lead width is not particularly limited, it may suitably be, for example, about 7 mm.

Referring back to FIG. 2, a cleaning roller 23 and a doctor blade 23*a* are shown which serve to clean the peripheral surface of the developing roller 2.

The developer feeder 1 so constructed as mentioned above is mounted on a base table 24 so as to be movable towards and away from the photoconductor drum 3 and moved by rotating a screw 26 with a handle 25, which allows making a fine adjustment of the gap between the photoconductor drum 3 and the developing roller 2 opposed thereto.

Also, the base table 24 is mounted on a base frame 27 which is movable in a direction in which the developer feeder I is movable and which is moved with a large stroke length by an actuator such as a rodless cylinder 28.

In a developing operation of the developer feeder 1 constructed as mentioned above in which the photoconductor roller 3 is rotated, the developing roller 2 and the feed rollers 7*a* and 7*b* are rotated to furnish the liquid developer 5 in the developer tank 4 onto the developing roller 2 via the feed rollers 7*a* and 7*b* and to cause a latent image formed on the photoconductor drum 3 by the liquid developer 5 furnished on the developing roller 2 to be developed.

Then, toner particles in the liquid developer 5 attached to the feed rollers 7*a* and 7*b* are caused to electrophoretically migrate and transferred onto the developing roller 2 via liquid films formed in gaps of 0.2 to 0.3 mm between the developing roller 2 and the feed rollers 7*a* and 7*b* rotationally engaged therewith. And, then, while the use of a single feed roller 7*a* or 7*b* may make out of constant in thickness the thin film layer of liquid developer coated on the peripheral surface of the developing roller 2 from the single feed roller 7*a* or 7*b* due to differences in the voltage, deviations in the gap and diffrences in the peripheral speed between the developing roller 2 and the single feed roller 7*a* or 7*b* which may vary and further to an assembling error of the developing roller 2 and the feed roller 7*a* or 7*b* and their dimensional errors at the time of manufacture, two (a plurality of) feed rollers 7*a* and 7*b* when used allows a coating of liquid developer to be lapped one on another over the developing roller 2 from the feed rollers, thereby making the thin film layer of liquid developer onto the developing roller 2 uniform in thickness. Further, with the two feed rollers 7*a* and 7*b* varied in diameter, the conditions under which the two feed rollers 7*a* and 7*b* are opposed to the developing roller 2 become mutually different, thereby promoting the effects gained by using a plurality of feed rollers.

Also, while the two feed rollers 7*a* and 7*b* are then rotated at an identical peripheral speed and adjusting the difference in peripheral speed between the feed rollers 7*a*, 7*b* and the developing roller allows the thin film layer mentioned above to be controlled in thickness, it has been found suitable by testing if the peripheral speed of the feed rollers 7*a* and 7*b* is made around 12% higher than that of the developing roller 2.

Then, with the smoother roller 13 axially reciprocated while rotating at a downstream of the feed rollers 7*a* and 7*b*, the liquid developer coated on the developing roller 2 from the feed rollers 7*a* and 7*b* is smoothened and made even by the smoother roller 13 while an excess of liquid developer on the developing layer 2 is removed thereby.

What is claimed is:

1. A developer feeder for wet development apparatus, the developer feeder comprising:

a developing roller rotationally engaged with a photoconductor drum, a plurality of feed rollers in part immersed in a liquid developer and rotationally engaged with the developing roller for supplying the liquid developer onto the developing roller, and a smoother roller axially movable to reciprocate while rotating in the same circumferential direction in which said developing roller is rotated, wherein the feed rollers have smooth peripheral surfaces and are arranged circumferentially of the developing roller, wherein said feed rollers are rotated at a same peripheral speed and in a same circumferential direction to that in which said developing roller is rotated, wherein said peripheral speed is variable, wherein the feed rollers have a downstream feed roller downstream from one or more other feed rollers in the circumferential rotation direction of the developing roller, and wherein the smoother roller is positioned for rotational engagement with the developing roller between a place at which the downstream feed roller is rotationally engaged with the developing roller and a place at which the developing roller is rotationally engaged with said photoconductor drum.

2. The developer feeder as set forth in claim 1, wherein the feed rollers are varied in diameter.

3. A developer feeder for wet development apparatus, the developer feeder comprising:

a developing roller rotationally engaged with a photoconductor drum;

a plurality of feed rollers in part immersed in a liquid developer and rotationally engaged with the developing roller for supplying the liquid developer onto the developing roller, the feed rollers having a downstream feed roller downstream from one or more other feed rollers in a circumferential rotation direction of the developing roller; and a smoother roller axially movable to reciprocate while rotating in the circumferential direction in which said developing roller is rotated;

wherein the feed rollers have smooth peripheral surfaces and are arranged circumferentially of the developing roller, and wherein the smoother roller is positioned for rotational engagement with the developing roller between a place at which the downstream feed roller is rotationally engaged with the developing roller and a place at which the developing roller is rotationally engaged with said photoconductor drum.

4. The developer feeder as set forth in claim 3, wherein the feed rollers are varied in diameter.

5. A developer feeder for wet development apparatus, the developer feeder comprising:

a developing roller rotationally engaged with a photoconductor drum, and a plurality of feed rollers in part immersed in a liquid developer and rotationally engaged with the developing roller for supplying the liquid developer onto the developing roller, wherein the feed rollers have smooth peripheral surfaces and are arranged circumferentially of the developing roller, wherein said feed rollers are rotated at a same peripheral speed and in a same circumferential direction to that in which said developing roller is rotated, wherein said peripheral speed is variable, and wherein the feed rollers are varied in diameter.

6. A developer feeder for wet development apparatus, the developer feeder comprising:

a developing roller rotationally engaged with a photoconductor drum, and a plurality of feed rollers in part immersed in a liquid developer and rotationally engaged with the developing roller for supplying the liquid developer onto the developing roller, wherein the feed rollers have smooth peripheral surfaces and are arranged circumferentially of the developing roller, wherein said feed rollers are rotated at a same peripheral speed and in a same circumferential direction to that in which said developing roller is rotated, wherein said peripheral speed is variable, and wherein said peripheral speed of at least one of said feed rollers is variable relative to said developing roller.

7. The developer feeder as set forth in claim 6, wherein said variable peripheral speed is not zero.

* * * * *